US005518085A

United States Patent [19]

Houser, Jr. et al.

[11] Patent Number: 5,518,085

[45] Date of Patent: May 21, 1996

[54] ASSEMBLY FOR APPLYING SOLID MATERIAL TO WHEELS

[75] Inventors: Howard M. Houser, Jr., Natrona Heights; Bruce R. Wise, North Huntingdon; William T. Urmson, Jr., Valencia, all of Pa.

[73] Assignee: Portec - RMP Division, Pittsburgh, Pa.

[21] Appl. No.: 391,141

[22] Filed: Feb. 21, 1995

[51] Int. Cl.[6] ..... B61K 3/00

[52] U.S. Cl. ..... 184/3.1; 184/99

[58] Field of Search ..... 184/2, 3.1, 3.2, 184/45.1, 45.2, 48.2, 99; 104/252, 257, 258, 279; 198/500; 238/1

[56] References Cited

U.S. PATENT DOCUMENTS

| | | | |
|---|---|---|---|
| 1,820,815 | 8/1931 | Maney . | |
| 2,018,402 | 10/1935 | Humphries et al. | 184/3.1 |
| 2,580,687 | 1/1952 | McMillan . | |
| 2,589,582 | 3/1952 | Strughold et al. . | |
| 2,903,090 | 9/1959 | Brown et al. . | |
| 3,147,822 | 9/1964 | Watts | 184/3.1 |
| 4,088,078 | 5/1978 | Noble . | |
| 5,054,582 | 10/1991 | Aracil . | |
| 5,305,853 | 4/1994 | Ross et al. . | |

FOREIGN PATENT DOCUMENTS

| | | | |
|---|---|---|---|
| 769184 | 10/1980 | U.S.S.R. . | |
| 1041370 | 9/1983 | U.S.S.R. . | |
| 1055677 | 11/1983 | U.S.S.R. . | |
| 0437189 | 10/1935 | United Kingdom | 184/3.1 |

*Primary Examiner*—Edward K. Look
*Assistant Examiner*—Christopher Verdier
*Attorney, Agent, or Firm*—Webb Ziesenheim Bruening Logsdon Orkin & Hanson

[57] ABSTRACT

An assembly for applying a solid material, such as a lubricant or an anti-slip material, to wheels. The system includes a pair of spring actuated members located on opposite ends of a holder for the solid material to urge the holder upwardly along guide pins to force the solid material to contact a wheel as it passes over a rail and the solid material element. The solid material element is held or "pinched" between the wheel flange and the gage face of the rail, thereby applying the material to the wheel which, in turn, transfers the material to the rail surface. The upward motion of the solid material is counteracted by a braking arrangement, including a brake release, so that a wheel passing over the release, releases the braking arrangement to allow the solid material to move upwardly to contact a wheel.

31 Claims, 10 Drawing Sheets

ASSEMBLY FOR APPLYING SOLID MATERIAL TO WHEELS

BACKGROUND OF THE INVENTION

1. Field of the Invention

This invention relates generally to an assembly for holding and applying a solid material to a railroad rail, and in particular, to applying a solid lubricant to moving surfaces such as the wheels of trains and other rolling stock for transfer of the solid material to the rail. The preferred embodiment of the present invention is designed to be fixed to one or more rails on which the rolling stock travels to apply the solid material to the wheels of the rolling stock as it passes over the assembly.

2. Background Information

It is a common practice to apply lubricant to the wheels of trains and other rolling stock to prevent wear and squealing noises while a train is traversing a curve. Oscillations of high frequency make annoying sounds which occur due to the twisting of the wheel axle and subsequent release of that twist as the curved rail is negotiated. This is particularly true for solid two wheel axle units, which is due to the difference in length of the outer and inner track of the curve. Applying lubricant to the wheel/rail interface reduces or eliminates the wear and squealing noises described above. In addition, applying lubricant to the wheel/rail interface substantially reduces wear of the rails and wheels, which in turn, extends useful life and reduces repair/replacement costs. Further, applying lubricant to the wheel/rail interface results in fuel savings for the vehicles negotiating such rails.

Existing arrangements for supplying lubricant to the wheel/rail interface include the use of a wayside grease box with a distribution manifold where a lubricant consisting of semi-solid grease is pumped onto the rails as the train crosses an actuator, whereupon the wheels carry the grease into the curve. A limitation with this system is that the grease is spread over a large area, including around the rails, ties, ballast, wayside devices and is splashed onto rolling stock. Another limitation with semi-solid grease systems is that the grease can enter cracks in the surface of the rail and, through hydraulic action, tend to propagate the cracks in the rail surface. A further limitation is that such systems require complex pumping and actuating devices to deliver the grease to the rail. Still another limitation is that such systems may propose an environmental hazard.

It is also known in the art to lubricate train and other railed vehicle wheels with an on-board solid lubricant. Examples of such systems are shown in U.S. Pat. Nos. 5,305,853; 4,088,078; 2,903,090; 2,589,582; 2,580,687; and 1,820,815. These on-board solid lubricant dispenser systems are mounted on the rolling stock itself and lubricate the wheel flange as the wheel rotates. Advantages of these on-board solid lubricants include reduced environmental hazard over the wayside grease box systems because grease is not spread over a large area. Further, the solid lubricant forms a constant but very small lubricant layer on the wheel and/or rail which is generally no more than one-half mil thick. Further, such on-board systems tend to last longer and require fewer design elements, such as complex pumping and distribution systems.

However, on-board solid lubricant systems suffer from limitations which wayside lubrication systems do not. First, the maintenance of wayside grease box systems is generally more controlled than the maintenance of rolling stock equipment due to the fact that rolling stock equipment is scattered throughout the country. In contrast, wayside maintenance is located within a given geographic area and usually is under the control of one organization which can pay closer attention to the maintenance of the system. Second, it is generally easier to lubricate a rail as opposed to refitting all rolling stock with solid lubricant systems. Third, wayside lubrication systems permit strategic placement of the lubrication equipment where it is needed, at the beginning of sharp turns. Fourth, wayside lubrication systems do not require constant lubrication of the wheels, which occurs with on-board solid lubricant systems mounted on rolling stock. Fifth, on-board lubrication systems are in many cases only fitted to the locomotives, and the lubrication provided in this manner at best, lubricates the locomotive and a few cars behind the locomotive, but is not sufficient to properly lubricate the rail/wheel interface for all of the remaining cars in the train.

Sixth, in some circumstances, there exists a need to lubricate both a wheel flange and a rail to provide sufficient lubrication for a given application and in this situation, it is advantageous to use both a wayside lubrication system and an on-board solid lubrication system.

A need exists in the art for a wayside lubrication system which does not suffer from the above-described limitations associated with the wayside grease box lubrication systems.

A need also exists in the art for a wayside system for applying solid materials, lubricating and otherwise, to the wheels of railed vehicles.

SUMMARY OF THE INVENTION

It is an object of the present invention to provide a wayside lubricant system which does not suffer from the significant limitations associated with wayside grease box lubrication systems known in the art. It is a further object of this invention to provide a wayside lubrication system which can be use in conjunction with on-board lubrication systems when and where needed. It is a further object of this invention to provide a wayside lubrication system which can be used in lieu of on-board lubrication systems to provide an alternative to the retrofitting of all rolling stock with on-board lubrication systems. It is also an object of the present invention to provide a wayside system for applying solid materials, lubricating or otherwise, to the wheels of railed vehicles.

These and other objects are obtained with the present invention, which includes a wayside assembly for applying solid material, and in particular, solid lubricant to the wheels of trains and other rolling stock as the wheels pass over the wayside assembly. The solid material, and in particular, the solid lubricant contemplated by the present invention can be provided in various lengths and heights depending primarily on the size of the rail to be coated and the portion of the wheel to be coated. Thus, for example, where a rail wheel is 108 inches in circumference, a solid material element could be fashioned in a length of 108 inches to coat the entire wheel circumference. Alternatively, a pair of assemblies for applying the solid material to wheels could be formulated with solid material elements approximately two feet in length each, and spaced apart by approximately two feet, which would then coat opposite quadrants of a wheel having a 108 inch diameter as the wheel passes over the pair of assemblies. Generally, however, the solid material is fashioned in the form of a plate approximately one-half of an inch thick by approximately two feet in length by approximately five inches in height to form a solid material element which is then installed in a solid material holder.

In one embodiment, the present invention comprises a pair of springs located at opposite ends of the solid material holder which operate on lift bars associated with the solid material holder to urge the solid material holder in the upward direction along guide pins to cause the solid material element to make contact with a train wheel or other rolling stock wheel as it passes over the rail and the solid material element. The solid material element is held or "pinched" between the wheel flange and the gage face of the rail.

The upward urging force of the pair of springs is counteracted by a pair of brakes which are part of the wayside assembly for applying solid material to the wheels of trains and other railed rolling stock.

The present invention further includes a pair of releases for the brakes, whereby a train wheel passing over the brake releases the pair of brakes and allows the solid material holder to move upwardly as urged by the pair of springs to cause the solid material element to contact the train or other rolling stock wheel. Completion of the passage of the train wheel over the pair of brake releases allows the pair of brakes to reset and hold the solid material element in the position where it made contact with the wheel.

In another embodiment of the present invention, actuation of a single brake release head simultaneously releases the pair of brakes.

In another embodiment of the present invention, no brake release is present, and the solid material holder is urged in a vertical or upward direction until it contacts the wheels by overcoming the braking force supplied by the brake due to the vibration imparted to the rail as the train or other rolling stock passes over the assembly for applying solid material.

In still another embodiment of the present invention, a single spring, a single brake and a single brake release as opposed to a pair of each, are utilized, particularly where the solid material element is of a limited length.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
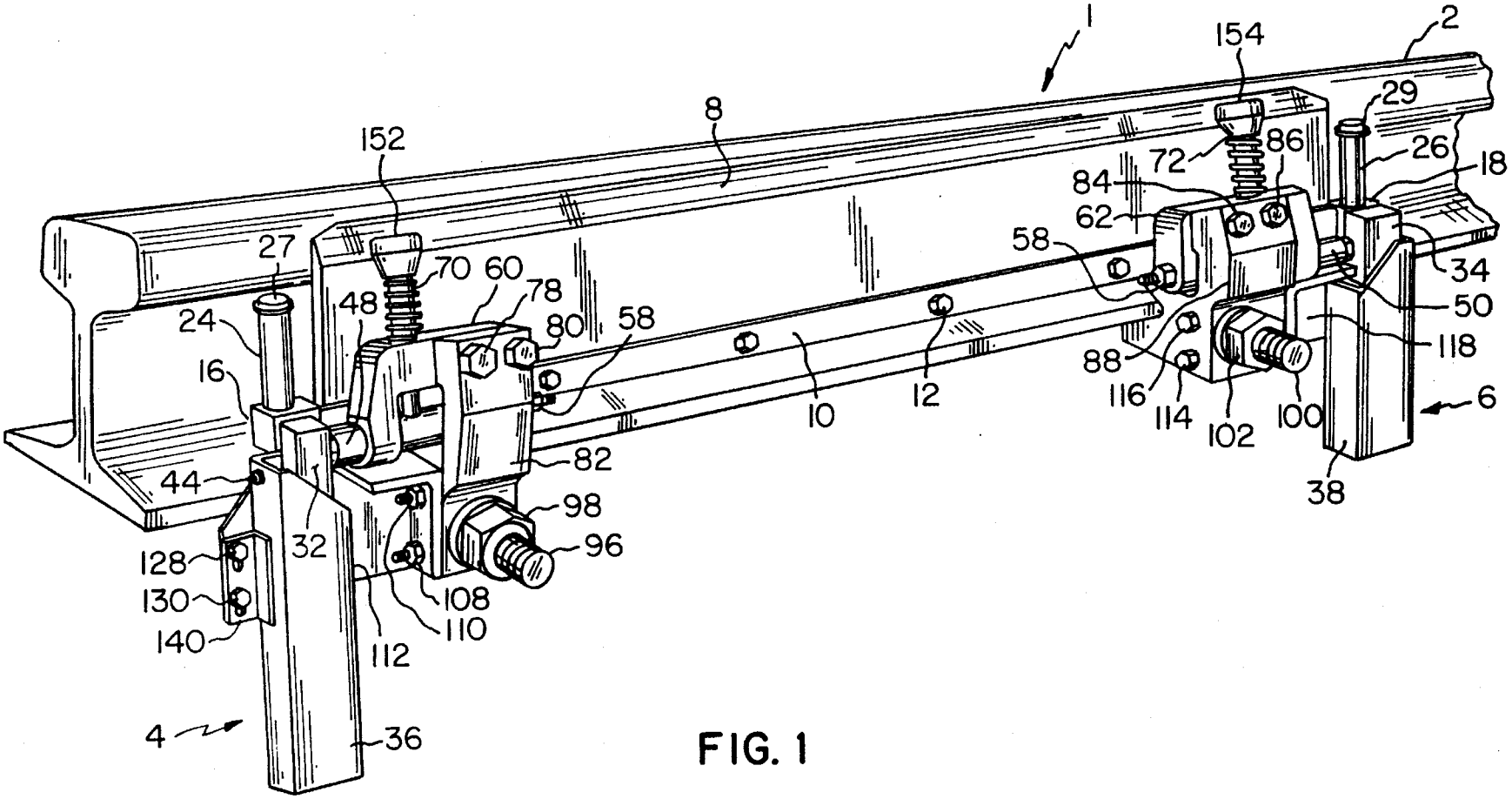
FIG. 1 is a front perspective view of the assembly of the present invention.

Referring to FIG. 1, the assembly for applying solid material 1 is mounted on a portion of a rail 2. The assembly has a left subassembly 4 and a right subassembly 6, which are mirror images of each other. Unless otherwise noted, the discussion of the elements of subassembly 4 applies in mirror image to subassembly 6.

As shown in FIG. 1, a solid lubricant element 8 is shown mounted in holder 10 via the bolts and nuts 12. It will be understood that any solid material can be held within holder 10, including but not limited to, lubricating and/or anti-slip materials. As noted above, the solid material contemplated by the present invention can be provided in various lengths and heights depending primarily on the size of the rail to be lubricated. Generally, the solid lubricant element 8 is in the form of a plate approximately one-half inch thick, approximately two feet in length and approximately five inches in height, which is then installed in holder 10. While bolts and nuts 12 are shown, it is to be understood that solid lubricant element 8 can be mounted in holder 10 by any well-known means including bonding, gluing, riveting and the like. Bolts and nuts 12 are preferred as they facilitate removal of element 8 and replacement with a fresh element 8.

Figure 2:
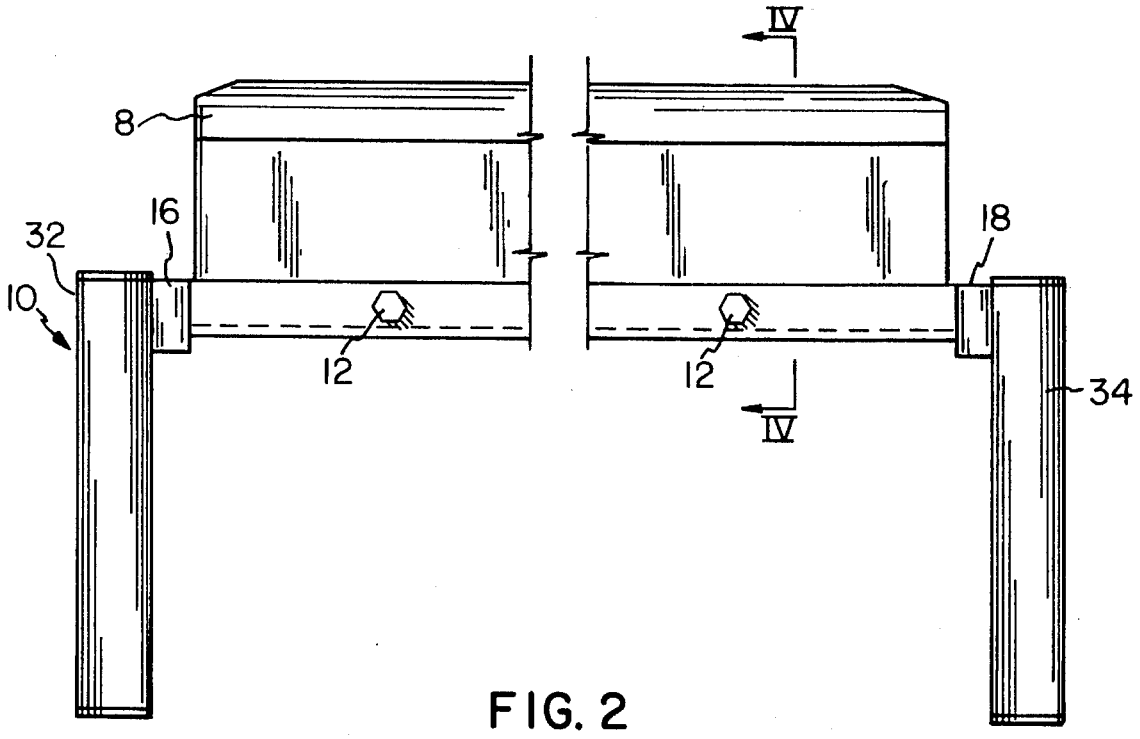
FIG. 2 is a front view of the solid material holder and solid material element.
Figure 3:
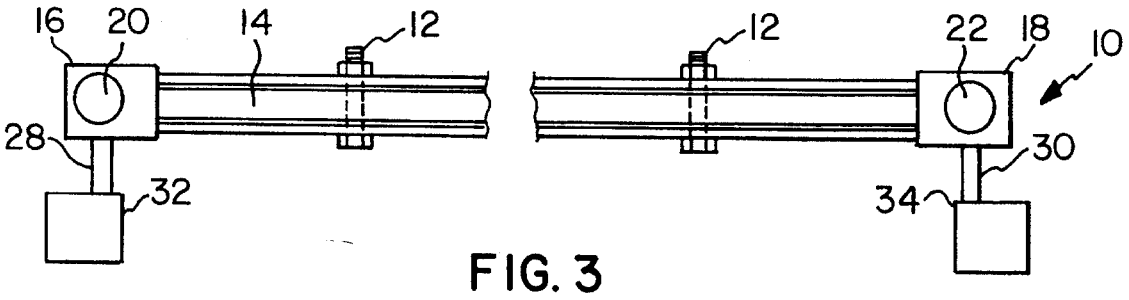
FIG. 3 is a top plan view of FIG. 2.
Figure 4:
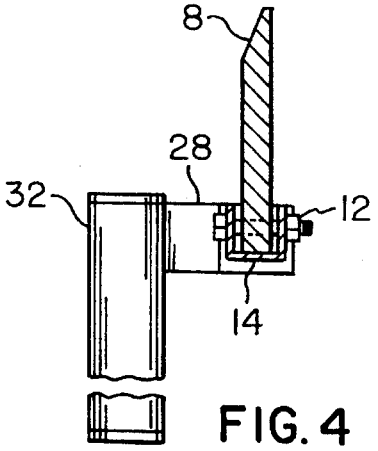
FIG. 4 is a section on line IV—IV of FIG. 2.

Holder 10 is shown in detail in FIGS. 2–4. Solid lubricant element 8 is shown mounted in a channel 14 by bolts and nuts 12. Referring in particular to FIG. 3, guide blocks 16 and 18 having holes 20 and 22, respectively, therethrough are located at opposite ends of channel 14. Guide blocks 16 and 18 travel along vertical guide pins 24 and 26 (shown in FIGS. 1 and 5) as holder 10 and solid lubricant element 8 float upwardly and downwardly along rail 2. Guide block holes 20 and 22 can simply comprise bored-through holes, or may, in the alternative, include a bearing or a bushing to facilitate travel of guide blocks 16 and 18 along guide pins 24 and 26, respectively. Where bearings are included, such bearings can include ball bearings, tapered bearings or spherical bearings. The bearings can further include dirt seals. The top of guide pins 24 and 26 are each fitted with a stop to prevent guide blocks 16 and 18 from traveling upwardly beyond the top of guide pins 24 and 26. This stop can be any stop known in the art, such as cotter pins, lock pins, etc. As shown in FIG. 1, this stop preferably comprises snap rings 27 and 29. Connecting members 28 and 30 connect guide blocks 16 and 18, respectively with lift bars 32 and 34. Holder 10 is an integral unit which includes guide blocks 16 and 18, connecting members 28 and 30 and lift bars 32 and 34. When solid lubricant element 8 is bolted with bolts and nuts 12 to holder 10, the resulting structure is permitted to float upwardly and downwardly as needed within subassemblies 4 and 6 when actuated by a passing train wheel as described below.

Figure 5:
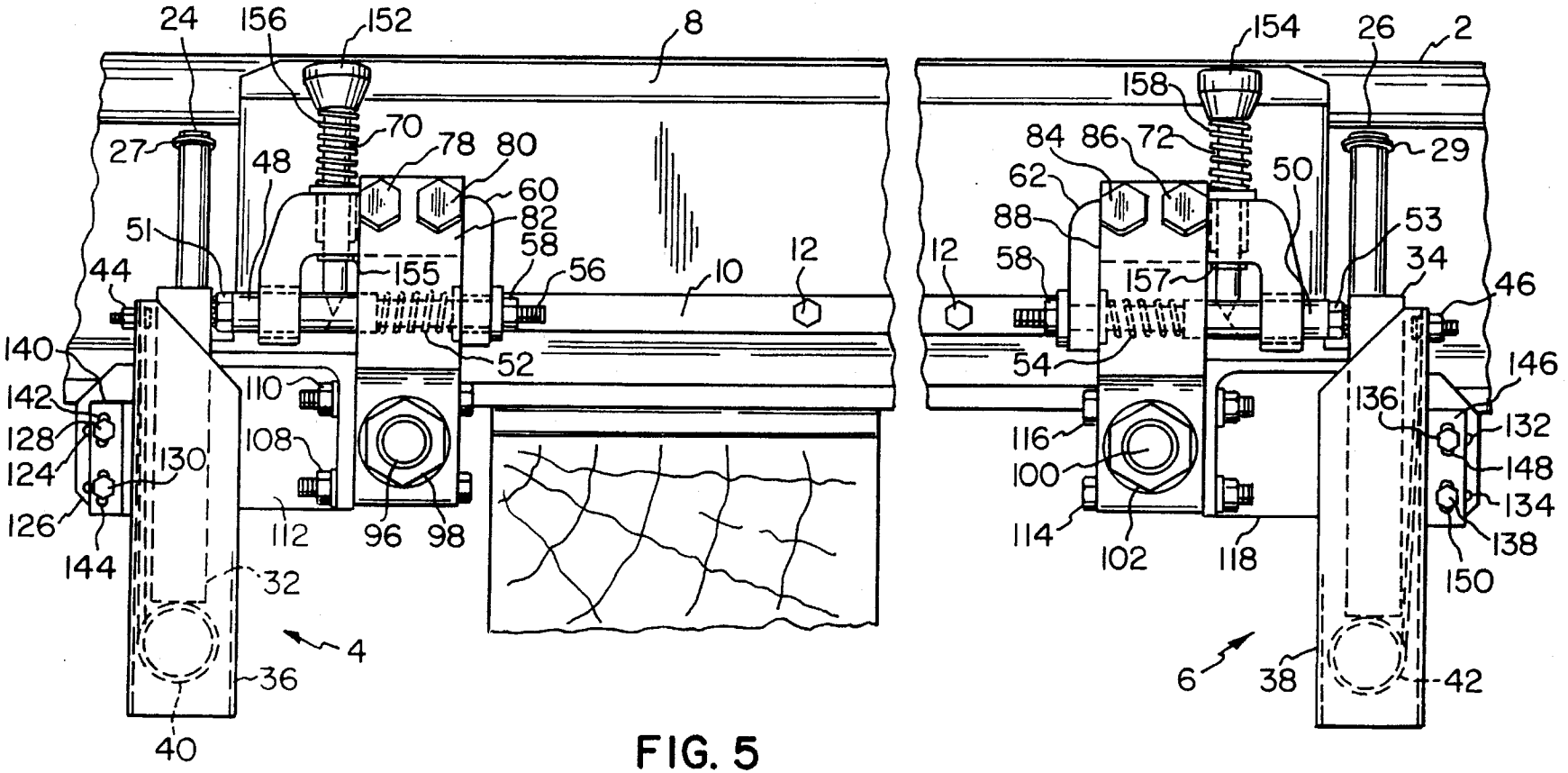
FIG. 5 is a front view of the assembly for applying solid material similar to FIG. 1, with several elements, shown in phantom.

Referring now to FIGS. 1 and 5, lift bars 32 and 34 are permitted to float upwardly and downwardly in lift bar guards 36 and 38, respectively, subject to the operation of a braking mechanism and a release mechanism discussed below. Upward force is supplied to lift bars 32 and 34 via a pair of respective springs, such as constant force springs, torsion springs, compression springs, leaf springs, coil springs, tension springs and the like. In a preferred embodiment, upward force is supplied to lifting bars 32 and 34 via flat steel coil springs 40 and 42, respectively, shown in FIG. 5 in phantom. Coil springs 40 and 42 are attached at one end to lift bar guards 36 and 38, respectively, via bolt and nut assemblies 44 and 46. The nature of flat steel coil springs 40 and 42 are such that they attempt to recoil themselves, thus providing upward force at the base of lift bars 32 and 34, respectively, which in turn forces holder 10 in an upwardly direction along guide pins 24 and 26.

Figure 6:
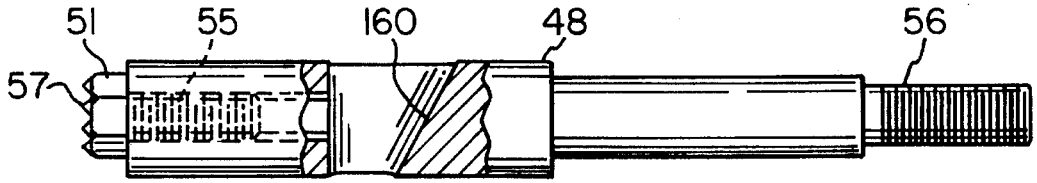
FIG. 6 is a front view partially in section of the braking rod of the present invention.

Upward travel of holder 10 is arrested by snap rings 27 and 29 On the upper ends of guide pins 24 and 26 or by a pair of braking assemblies shown in FIGS. 1 and 5. The braking assemblies are disposed in a generally horizonal plane with respect to the vertical rail gage face. The braking assemblies include braking rods 48 and 50 which are urged via brake springs 52 and 54, respectively, into contact with lift bars 32 and 34, respectively. The holder 10 is thereby pinched or "braked" from further upward or vertical movement by virtue of lift bars 32 and 34 being "pinched" or held by the brake rods 48 and 50, respectively. As shown in FIGS. 5 and 6, the brake rod 48 (of which brake rod 50 is the mirror image) includes at a first end, threads 56, onto which nut 58 is threaded to permit adjustment of the horizontal travel and braking force applied by braking rods 48 and 50. Brake rods 48 and 50 are each also fitted at a second end with heads 51 and 53, respectively. Heads 51 and 53 can be machined as part of rods 48 and 50, respectively, or as shown in more detail in FIG. 6, head 51 may be a bolt fitted with threads 55 which engage corresponding threads in brake rod 48. The face of head 51, which engages lift bar 32, is shown in FIG. 6 as having a roughened or serrated face having gripping teeth 57 for providing additional frictional force between head 51 and lift bar 32. In an alternative embodiment, the face of head 51 can simply be a smooth surface.

Figure 7:
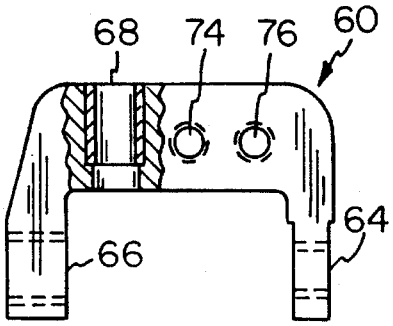
FIG. 7 is a front view partially in section of the brake rod and release rod guide of the present invention.
Figure 8:
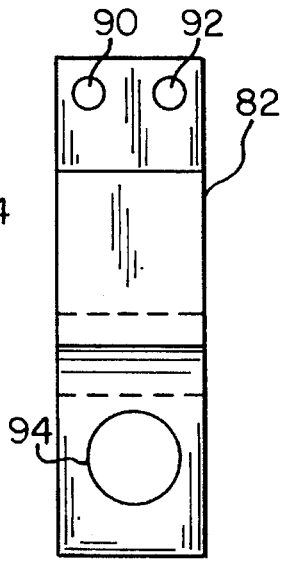
FIG. 8 is a front view of the rail clamp of the present invention.

Braking rods 48 and 50 travel horizontally in brake rod and release rod guides 60 and 62, respectively, as shown in FIGS. 1 and 5. With reference to FIG. 7, brake rod and release rod guide 60, of which brake rod and release rod guide 62 is the mirror image, includes a pair of horizontal guide holes 64 and 66 through which brake rod 48 travels in a generally horizontal direction with respect to rail 2. Brake rod and release rod guide 60 includes a vertical guide hole 68 through which release rod 70 travels in a generally vertical direction. Brake rod and release rod guide 60 further includes a pair of threaded mounting holes 74 and 76 through which mounting bolts 78 and 80 are inserted to mount brake rod and release rod guide 60 to rail clamp 82. Similarly, mounting bolts 84 and 86 are shown in FIGS. 1 and 5 for brake rod and release rod guide 62, whereupon it is mounted on rail clamp 88.

Figure 9:
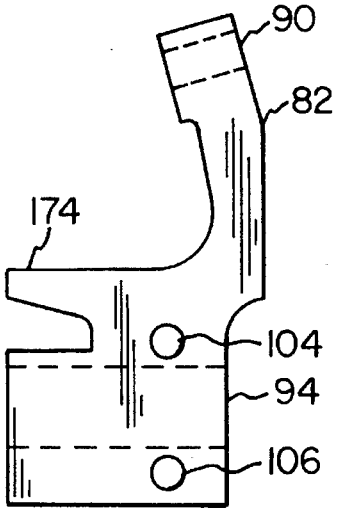
FIG. 9 is a side view of the rail clamp shown in FIG. 8.

Rail clamps 82 and 88 are identical in structure. Rail clamp 82 is provided with a pair of holes 90 and 92 through which mounting bolts 78 and 80 are inserted to hold brake rod and release rod guide 60 in place in subassembly 4. A through hole 94 is provided in rail clamp 82 through which a "J" type bolt 96 (shown in FIGS. 1, 5 and 13) is inserted to catch the lower flange on the opposite edge of rail 2, whereupon it is tightened in place by a nut 98 to affix subassembly 4 to rail 2. Subassembly 6 is similarly affixed to rail 2 by a rail clamp 88, a J-bolt 100 and a nut 102. Two additional holes 104 and 106 are provided in rail clamp 82 as shown in FIG. 9, through which are inserted mounting bolt and nut assemblies 108 and 110 to mount guide pin bracket 112 to rail clamp 82. Rail clamp 88 similarly has a pair of holes provided therein for insertion of mounting bolts 84 and 86 and a second pair of holes for accepting mounting bolt and nut assemblies 114 and 116 for mounting guide pin bracket 118.

Figure 10:
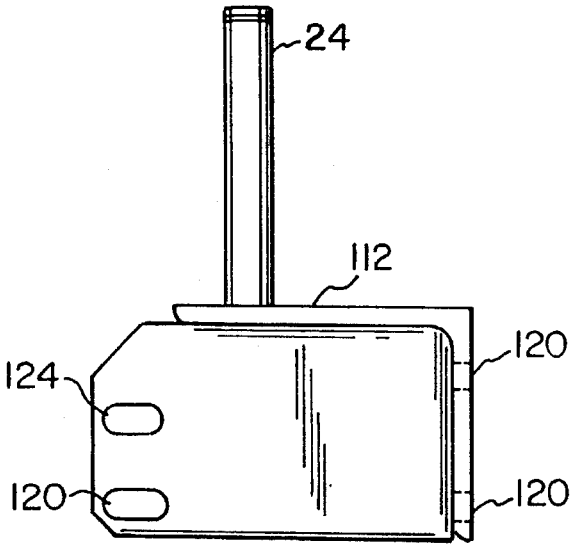
FIG. 10 is a front view of the guide pin bracket assembly of the present invention.

Guide pin brackets 112 and 118 are mirror images of each other guide pin bracket 112 is shown in FIG. 10 and includes guide pin 24. A pair of slots 120 and 122 are provided in guide pin bracket 112 to accept mounting bolt and nut assemblies 108 and 110, respectively. Guide pin bracket 112 is provided with pair of slots 124 and 126 for accepting mounting bolt and nut assemblies 128 and 130 which affix lift bar guard 36 to guide pin bracket 112. Guide pin bracket 118 similarly includes guide pin 26 and a pair of holes for accepting bolt and nut assemblies 114 and 116 for mounting guide pin bracket 118 to rail clamp 88, and an additional pair of slots 132 and 134 for accepting mounting bolt and nut assemblies 136 and 138 for mounting lift bar guard 38 to guide pin bracket 118.

Figure 11:
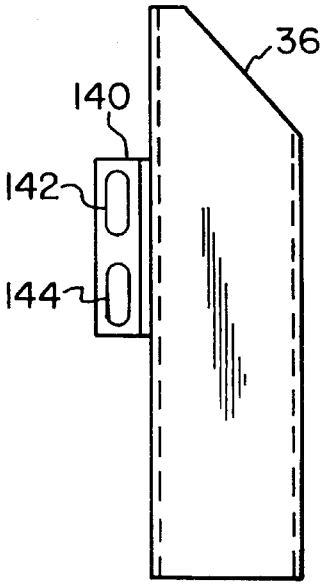
FIG. 11 is a front view of the lift bar guard of the present invention.

Lift bar guards 36 and 38 are mirror images of each other. Lift bar guard 36 is shown in FIG. 11 with a mounting bracket 40 affixed thereto. Mounting bracket 140 includes mounting slots 142 and 144 through which mounting bolt and nut assemblies 128 and 130 are inserted as shown in FIGS. 1 and 5 to mount lift bar guard 36 to guide pin bracket 112. Similarly, guide pin bracket 118 includes mounting bracket 146 which includes slots 148 and 150 through which are inserted mounting bolt and nut assemblies 136 and 138 for mounting lift bar guard 38 to guide pin bracket 118. Slots are preferred in mounting brackets 140 and 146 and in guide pin brackets 112 and 118 to permit final adjustment of the assembly when mounted on the rail 2.

The braking provided by the above-described braking assemblies is overcome with a pair of release assemblies which release the braking assemblies as follows. As shown in FIGS. 1 and 5, release rods 70 and 72 are each fitted at a top end with a cap or head 152 and 154, respectively. It is to be noted that in one embodiment of the present invention, heads 152 and 154 can be machined as integral portions of release rods 70 and 72, respectively. In an alternative embodiment, heads 152 and 154 can be formed separately and attached to release rods 70 and 72, respectively, by any well-known means, such as welding, threading or the like. One advantage of a threaded attachment is that should heads 152 and 154 become damaged or excessively worn, replacement is easily facilitated. A pair of springs 156 and 158 operating on heads 152 and 154, respectively, urge release rods 70 and 72 in an upwardly direction, respectively, until a stop is reached. The stop can include a cotter pin or locking pin, but in a preferred embodiment as shown in FIG. 5, the stops are snap rings 155 and 157, respectively. The end of release rods 70 and 72 opposite the heads 152 and 154 respectively, are each fitted with a narrowed tapered shank as shown in FIG. 5 in phantom. As shown in more detail in FIG. 6, brake rod 48 (and 50, though not shown in FIG. 6) is machined with a tapered groove 160 for receiving the tapered shank of release rods 70 and 72, respectively. As shown in FIG. 5, when release rods 70 and 72 are urged in the upwardly position, brake rods 48 and 50 will press against the solid lubricant holder 10 and brake it from further upward (or downward) movement. However, when the weight of a train wheel is placed on heads 152 and 154, respectively, the force of springs 156 and 158 is respectively overcome, driving release rods 70 and 72 in a downward direction, which, in turn, operates on the inclined planes of tapered grooves 160 of brake rods 48 and 50, respectively. Brake rods 48 and 50, in turn, are urged against brake springs 52 and 54 and away from lift bars 32 and 34, thereby removing the braking force of brake rods 48 and 50 allowing holder 10 and solid lubricant element 8 to float freely between the downward pressure of the train wheel and the upward pressure of flat steel coil springs 40 and 42 along guide pins 24 and 26, respectively. The placement or removal of one or more washers (not shown) in the interface between head 51 and braking rod 48 permits tapered groove 160 to be shifted correspondingly to the left or right, which, in turn, changes the point of contact of the tapered end of release rod 70 with tapered groove 160, thereby permitting adjustment of the length of travel or stroke of release rod 70 necessary to effect release of brake rod 48 on lift bar 32. Brake rod 50 and head 53 are adjusted in an identical fashion. It is to be noted that tapered groove 160 extends completely through brake rod 48 to permit release rod 70 (and 72 for brake rod 50, not shown in FIG. 6) to pass completely through brake rod 48 should a train wheel be so worn as to push release rod 70 downwardly that far. When the weight of the train wheel is removed, release rods 70 and 72 are again urged upwardly and brake rods 48 and 50 are permitted to reexert braking pressure against lift bars 32 and 34 as described above. While the foregoing discussion is directed to a mechanical brake release, it would also be possible to replace the mechanical brake release with an electrical brake release system as will be understood by one skilled in the art.

Figure 12:
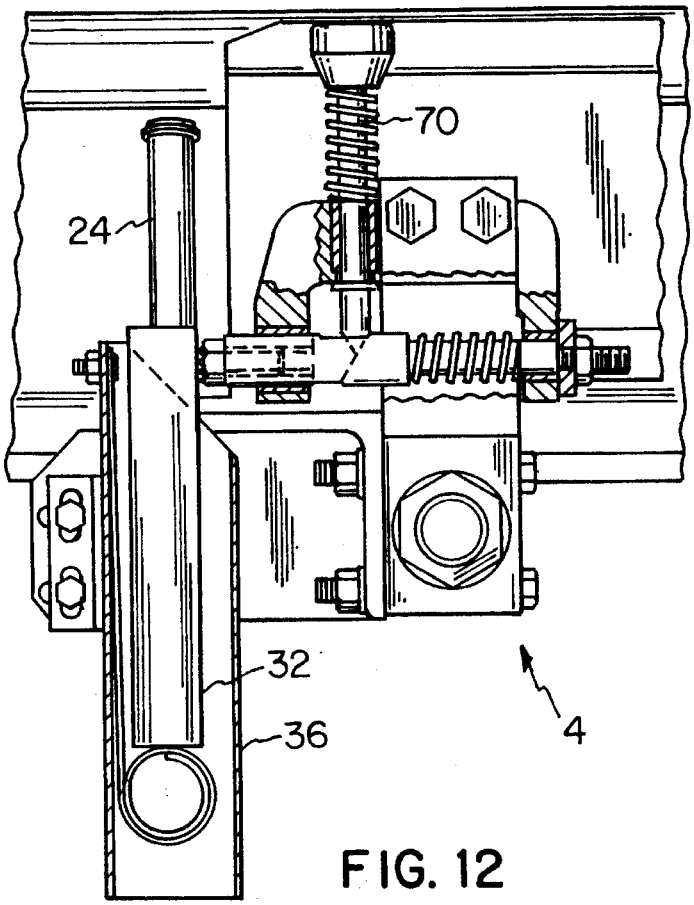
FIG. 12 is a front view partially in section of the left half of the assembly for applying solid material of the present invention.
Figure 13:
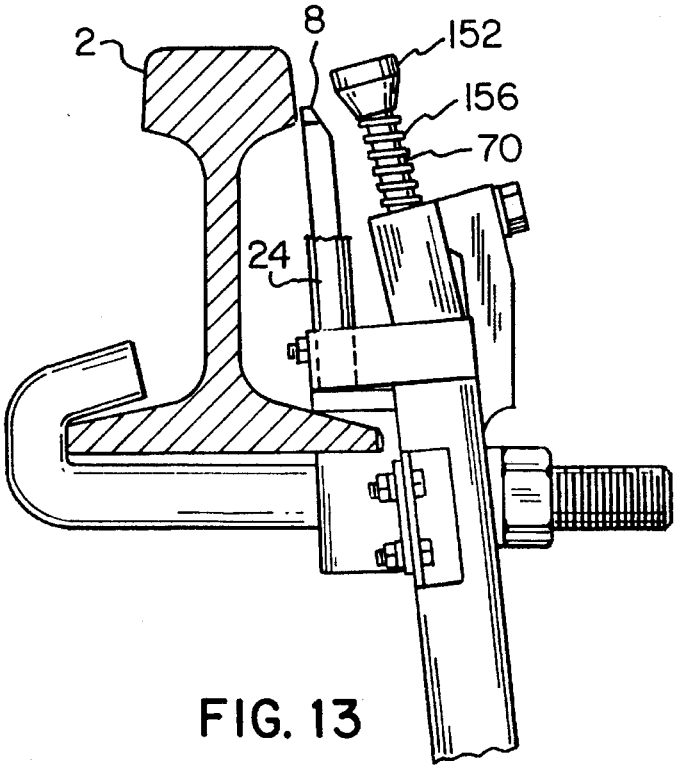
FIG. 13 is a side view partially in section of the left half of the assembly for applying solid material of the present invention showing the assembly before actuation by a train wheel and before the contact of the solid material element with the train wheel.
Figure 14:
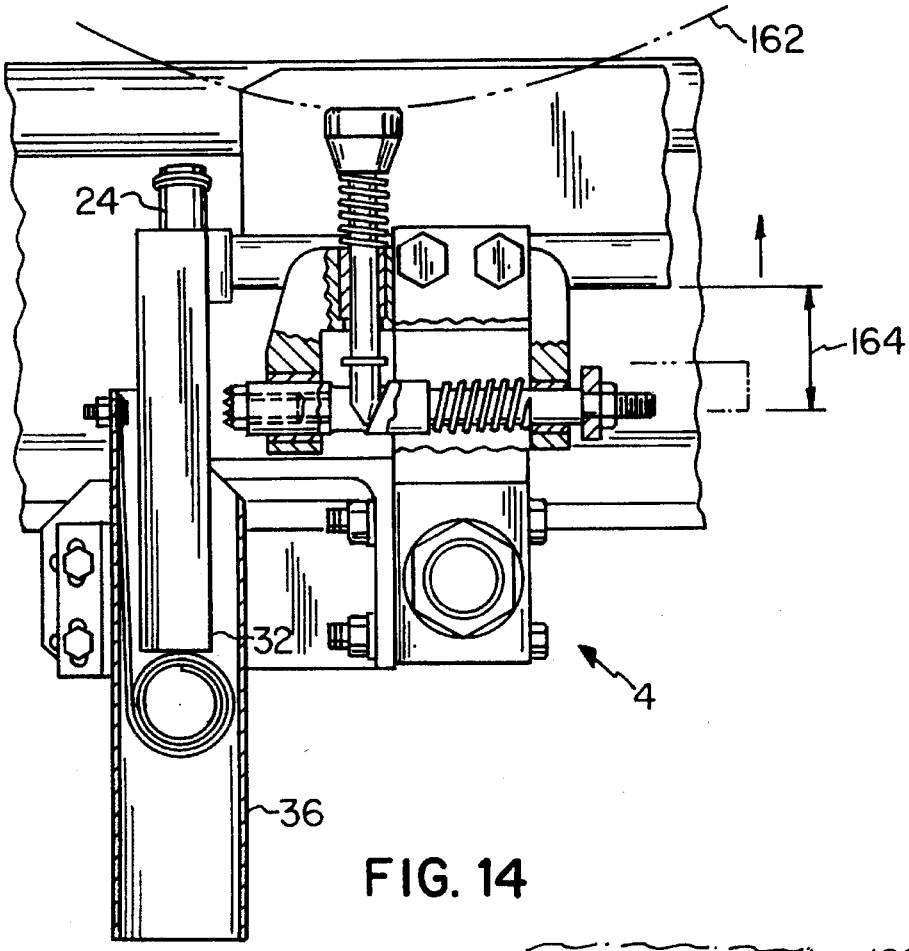
FIG. 14 is a front view partially in section of the left half of the assembly showing the assembly during actuation by a train wheel.

The operating cycle of the brake release is shown in FIGS. 12–14. FIG. 12 is a front elevational view of subassembly 4, a portion of solid lubricant element 8 and solid lubricant holder 10 showing release rod 70 in its most upwardly direction of travel. As shown in phantom, the tapered shank of release rod 70 is at or near the top of tapered groove 160, shown in phantom, of brake rod 48, and brake rod 48 is exerting a braking force on lift bar 32. Similarly, as shown in FIG. 13, solid lubricant element 8 is shown significantly displaced below the top of rail 2, as it might be when first installed on the rail.

Figure 15:
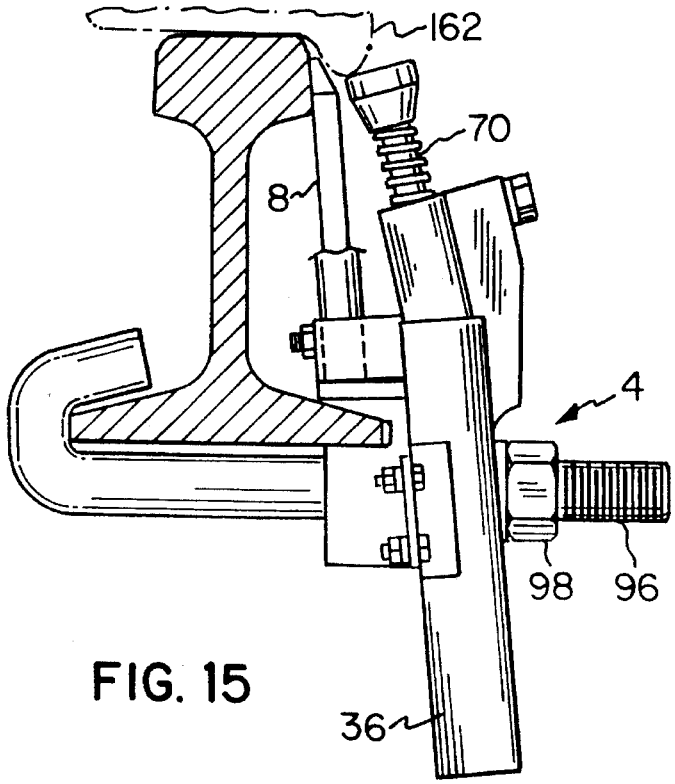
FIG. 15 is a side view of the left half of the assembly for applying solid material showing the assembly during actuation by a train wheel.

As shown in FIG. 14, the weight of the wheel flange 162, shown in phantom, forces release rod 70 downwardly compressing spring 156 and forcing brake rod 48 away from lift bar 32 by action of the tapered shank of release rod 70 on tapered groove 160. Solid lubricant holder 10 is free to travel upwardly the distance indicated by 164 until solid lubricant element 8 is pinched between wheel flange 162 and rail 2, as best shown in FIG. 15. When the train wheel passes over release rod 70, release rod 70 is urged upwardly by spring 156 permitting braking rod 48 to exert braking force on lift bar 32 as described above.

Figure 16:
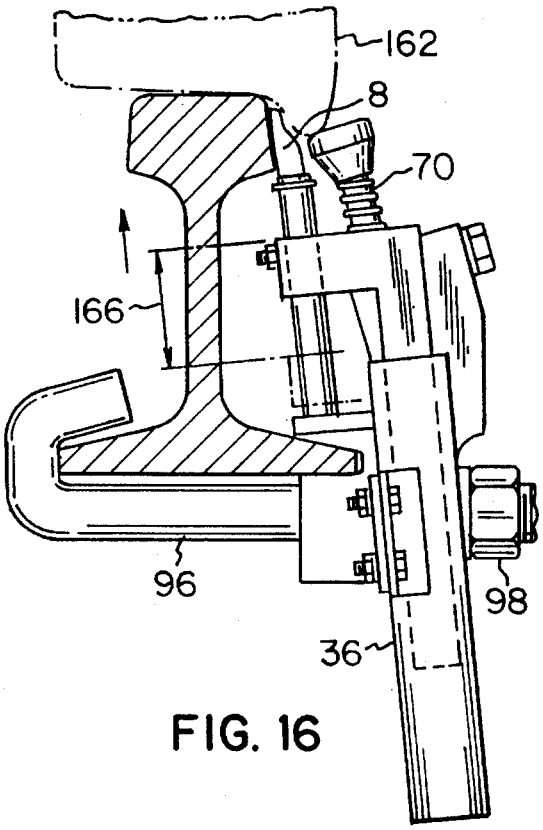
FIG. 16 is a side view of the left half" of the assembly for applying solid material showing the assembly during actuation by a train wheel after the solid material element has incurred much wear and showing the difference in upward travel of the solid material holder before and after such wear.

It will be immediately obvious that the present invention has two important attributes. First, the height of solid lubricant element 8 with respect to rail 2 and wheel flange 162 is self-leveling and will prevent shearing of solid lubricant 8, as would occur if solid lubricant 8 were permanently affixed at a given height. Second, the assembly 1 of the present invention permits solid lubricant 8 to re-level itself with each passing of a train wheel over release rods 70 and 72, thereby compensating for wear of solid lubricant element 8. This is shown in FIG. 16, where solid lubricant element 8 is shown in a significantly worn condition, and solid lubricant holder 10 has traveled the distance 166, and by the relative positions of solid lubricant holder 10 as shown in phantom lines.

Figure 18:
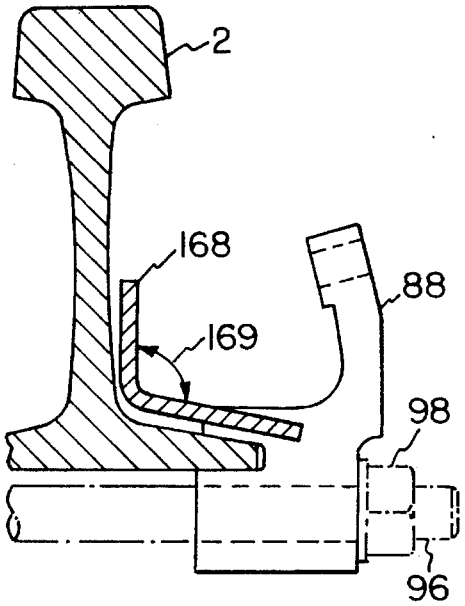
FIG. 18 is a sectional view which is partially in section along the line XVIII—XVIII of FIG. 17.
Figure 17:
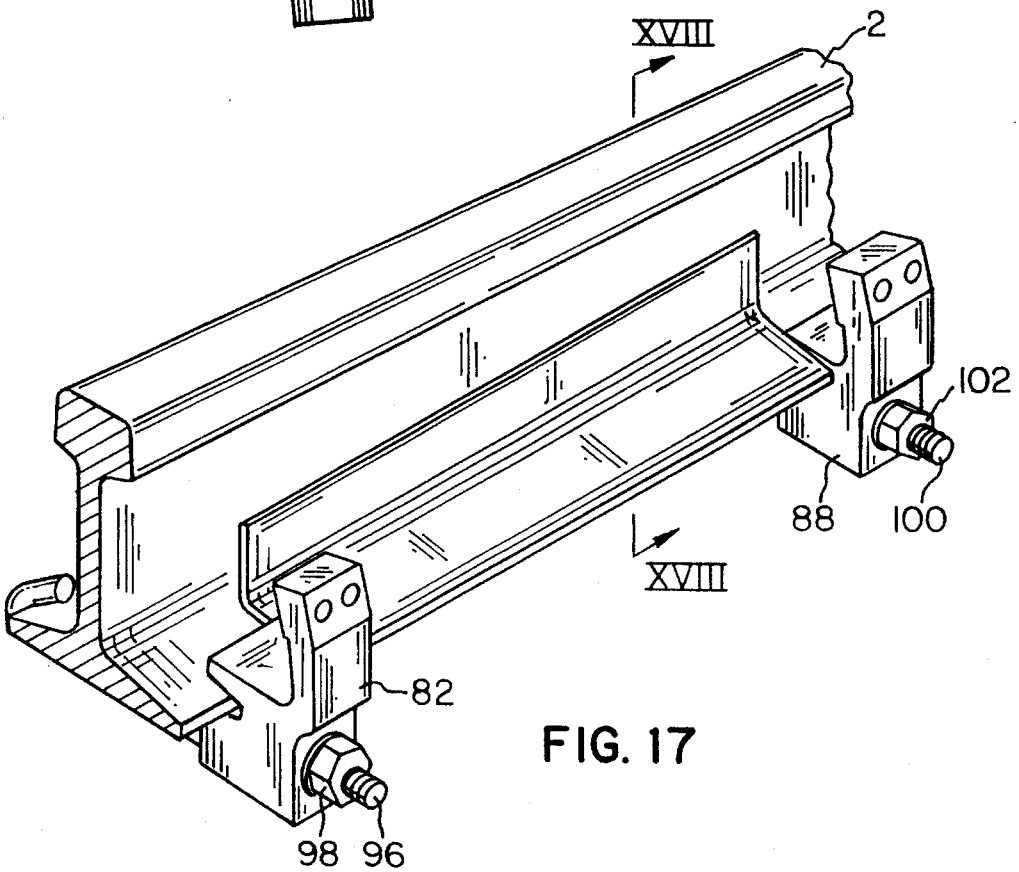
FIG. 17 is a perspective partially in section of an alternative embodiment of the present invention.

FIGS. 17 and 18 show an alternative embodiment of the present invention with a connecting bar 168 interspersed between and affixed to rail clamps 82 and 88. It has been found in some applications that due to the presence of dirt under rail clamps 82 or 88, or bending of the rail or for any other reason, when rail clamps 82 and 88 are attached with J-bolts 96 and 100 and nuts 98 and 102, respectively, the orientations of rail clamps 82 and 88 in a vertical plane are not precisely parallel. In essence, a twisting has occurred. To ensure that the orientations in a vertical plane are substantially parallel, connecting bar 168 is fixed to rail clamps 82 and 88 before rail clamps 82 and 88 are attached to the rail with their respective J-bolt and nut assemblies. Connecting bar 168 can be fixed to rail clamps 82 and 88 by any means known in the art, including bolting or welding, although welding is preferred because once the parallel orientation of the rail clamps 82 and 88 is obtained, it will not change. Connecting bar 168 is shown as an angle bracket in FIGS. 17 and 18, but it is to be understood that it could take any form, such as a box, channel, H-beam, I-beam or flat steel construction so long as the construction maintains the parallel vertical orientation of rail clamps 82 and 88 when the clamps are affixed to the rail with their respective J-bolt assemblies. Where an angle bracket is used, as shown in FIG. 18, the angle 169 can be more than 90 degrees to more closely follow the angle between the rail base and its vertical face. Affixing rail clamps 82 and 88 in a substantially parallel vertical plane will in turn permit guide pin brackets 112 and 118 to be affixed and adjusted with the above-described slots to ensure that guide pins 24 and 26 will be oriented in a substantially parallel vertical plane. This will prevent binding of holder 10 as it travels upwardly and downwardly along guide pins 24 and 26.

Figure 19:
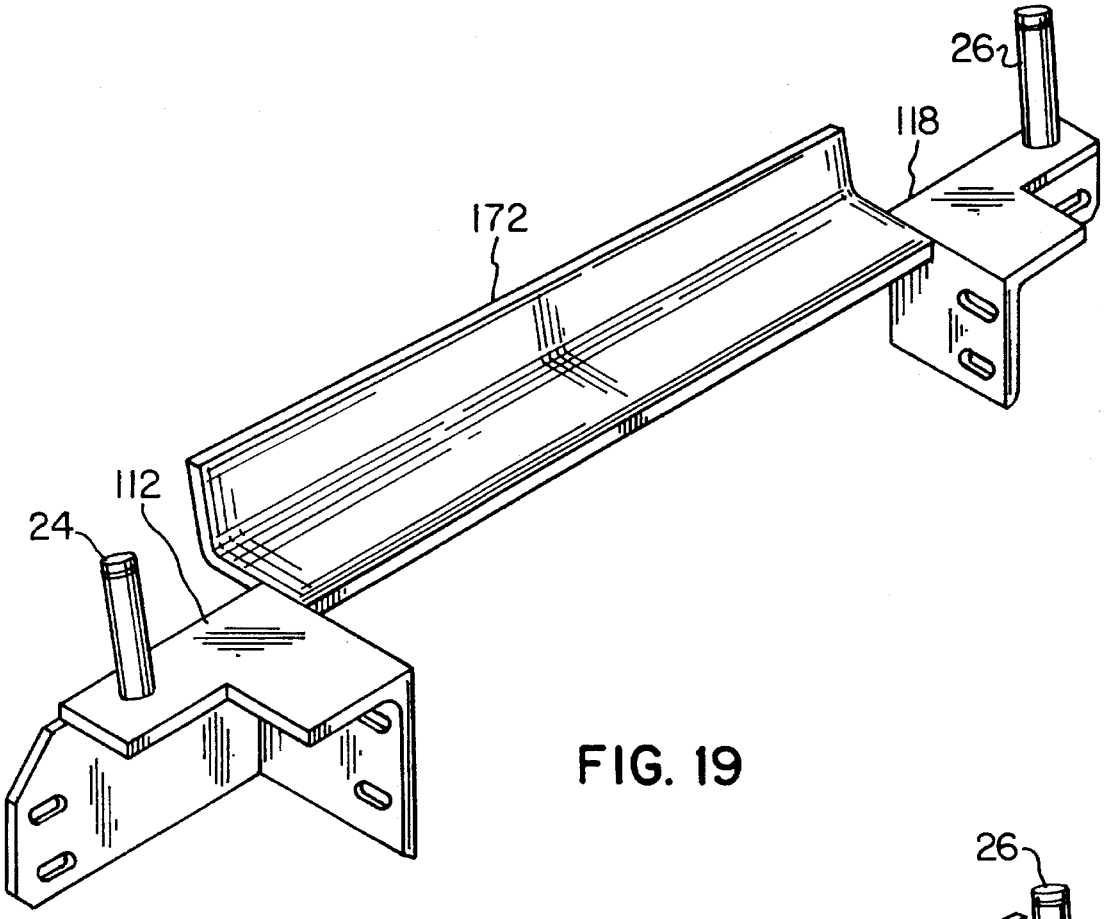
FIG. 19 is a perspective of an alternative embodiment of the present invention.

FIG. 19 shows an alternative embodiment of the invention wherein connecting bar 172 is interspersed between and fixed to guide pin brackets 112 and 118. The function of connecting bar 172 is essentially the same as the function of the connecting bar 168 in FIG. 17 to ensure that orientations in a vertical plane of guide pins 24 and 26 are substantially parallel to prevent any binding of solid lubricant holder 10 as it travels upwardly and downwardly along guide pins 24 and 26. The assembly shown in FIG. 19 is placed along the rail surface, and rail clamps 82 and 88 are placed against the rail and adjacent guide pin brackets 112 and 118, respectively, whereupon mounting bolt and nut assemblies 108 and 110, and 114 and 116 are used to affix guide pin brackets 112 and 118, respectively, to rail clamps 82 and 88, respectively. It is to be appreciated that the lip 174 of rail clamp 82 as shown in FIG. 9 and the corresponding lip of rail clamp 88 (not shown) may have to be slightly shortened to accommodate connecting bar 172. Welding is again the preferred method of fixing connecting bar 172 to guide pin brackets 112 and 118 because once the parallel orientation of the guide pin brackets is obtained, it follows that the guide pins 24 and 26 will also be parallel.

Figure 20:
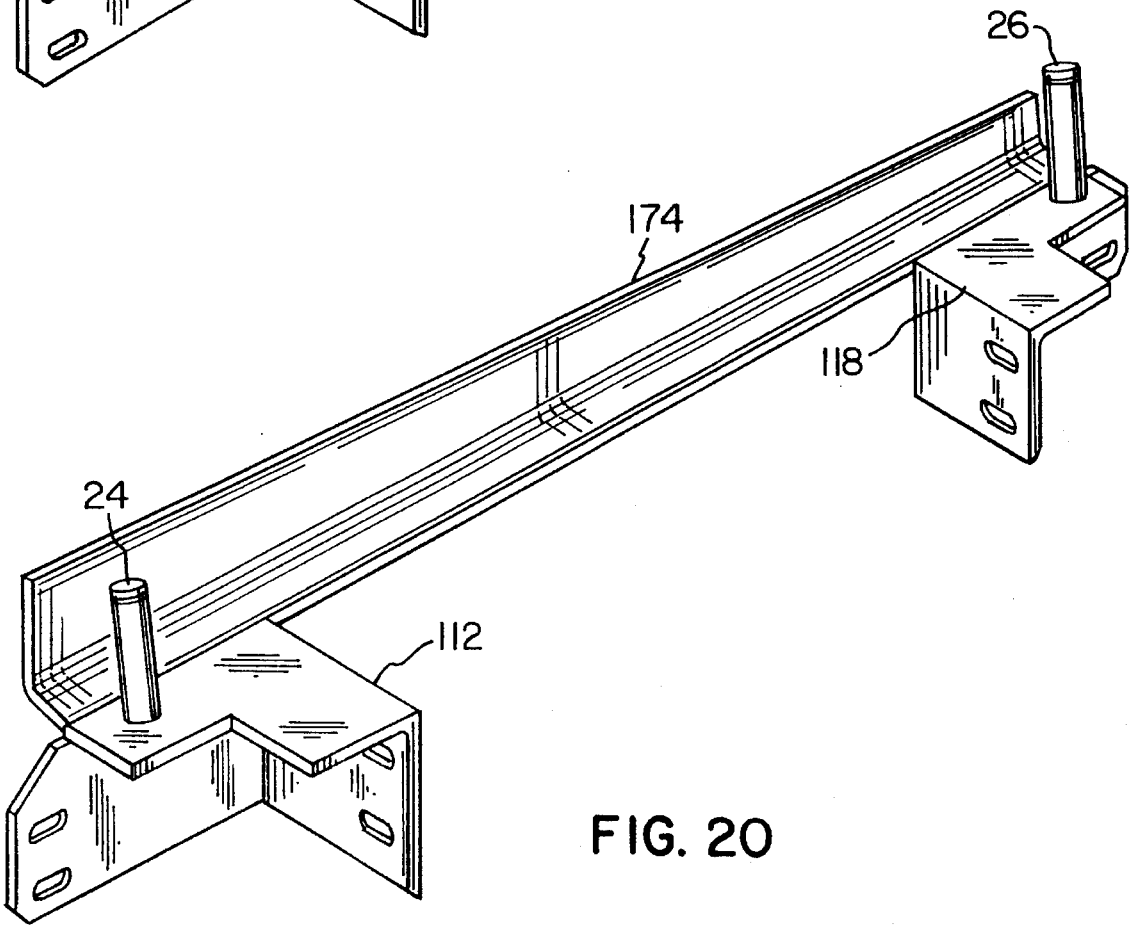
FIG. 20 is a perspective of another embodiment of the present invention.

Shown in FIG. 20 is an alternative embodiment of the invention, wherein connecting bar 174 is shown affixed to the respective faces of guide pin brackets 112 and 118 which are parallel to the rail 2 (not shown). Welding is again the preferred method of fixing connecting bar 172 to guide pin brackets 112 and 118 and functions in essentially the same manner as connecting bar 172 to ensure that guide pins 24 are oriented in a vertical plane that is substantially parallel.

Figures 21, 23:
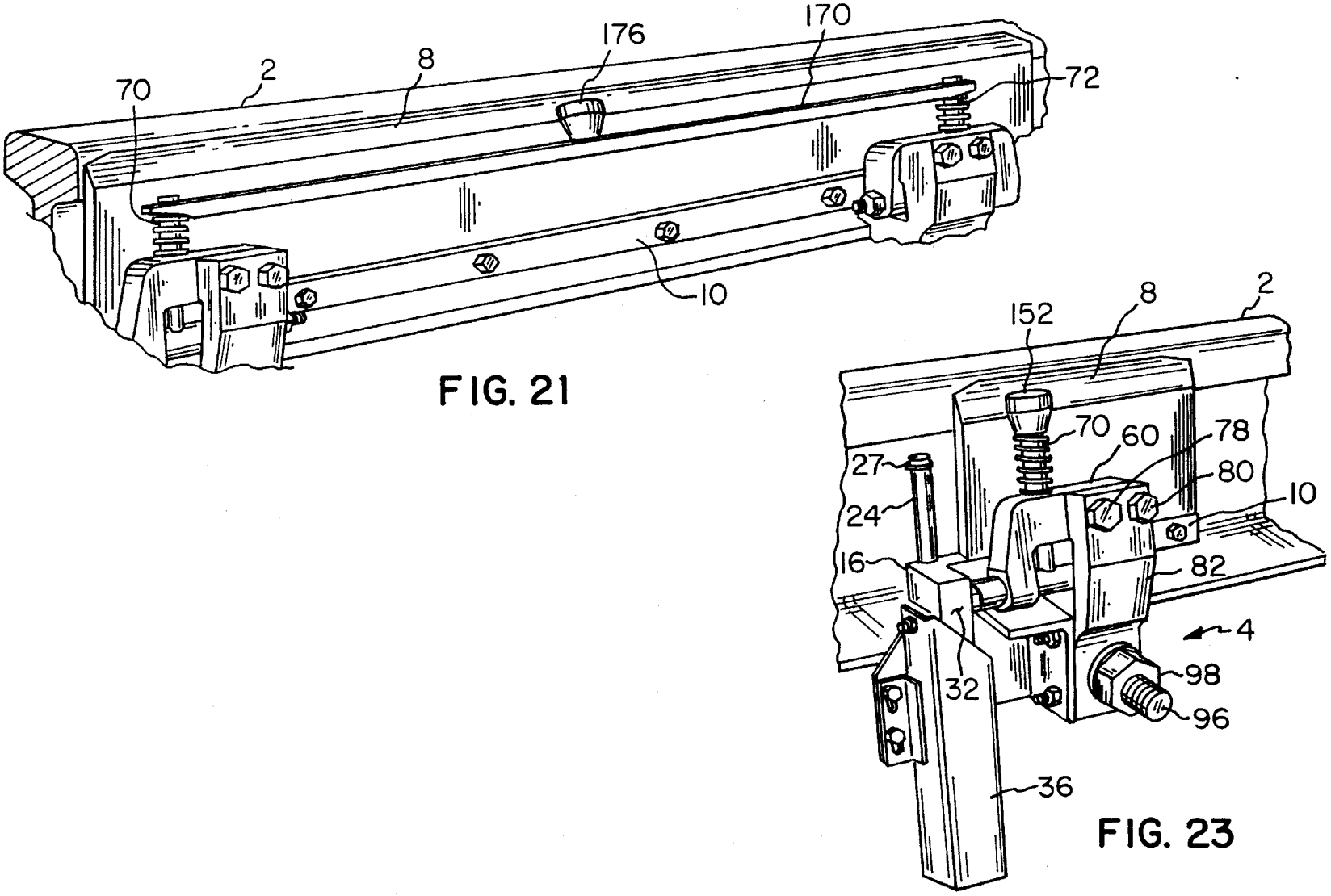
FIG. 21 is a perspective of an alternative embodiment of the present invention.
FIG. 23 is a perspective of an alternative embodiment of the present invention.

FIG. 21 shows an alternative embodiment of the invention wherein a connecting bar 170 is interspersed between and fixed to release rods 70 and 72. Release rods 70 and 72 are shown in FIG. 21 without release rod heads 152 and 154 described above, and instead, release head 176 is affixed to connecting bars 170. When a train wheel passes over the assembly shown in FIG. 21 from either direction, left or right, the downward pressure of the wheel will force release head 176 in a downward direction, which, in turn, will simultaneously force the release rods 70 and 72 downwardly. In this embodiment, both the left and right sides of solid lubricant holder 10 are released simultaneously to allow solid lubricant element 8 to float upwardly to engage the wheel. This prevents any possible twisting or cocking of solid lubricant element 8 caused by releasing one side of solid lubricant holder 10 before the other.

Figure 22:
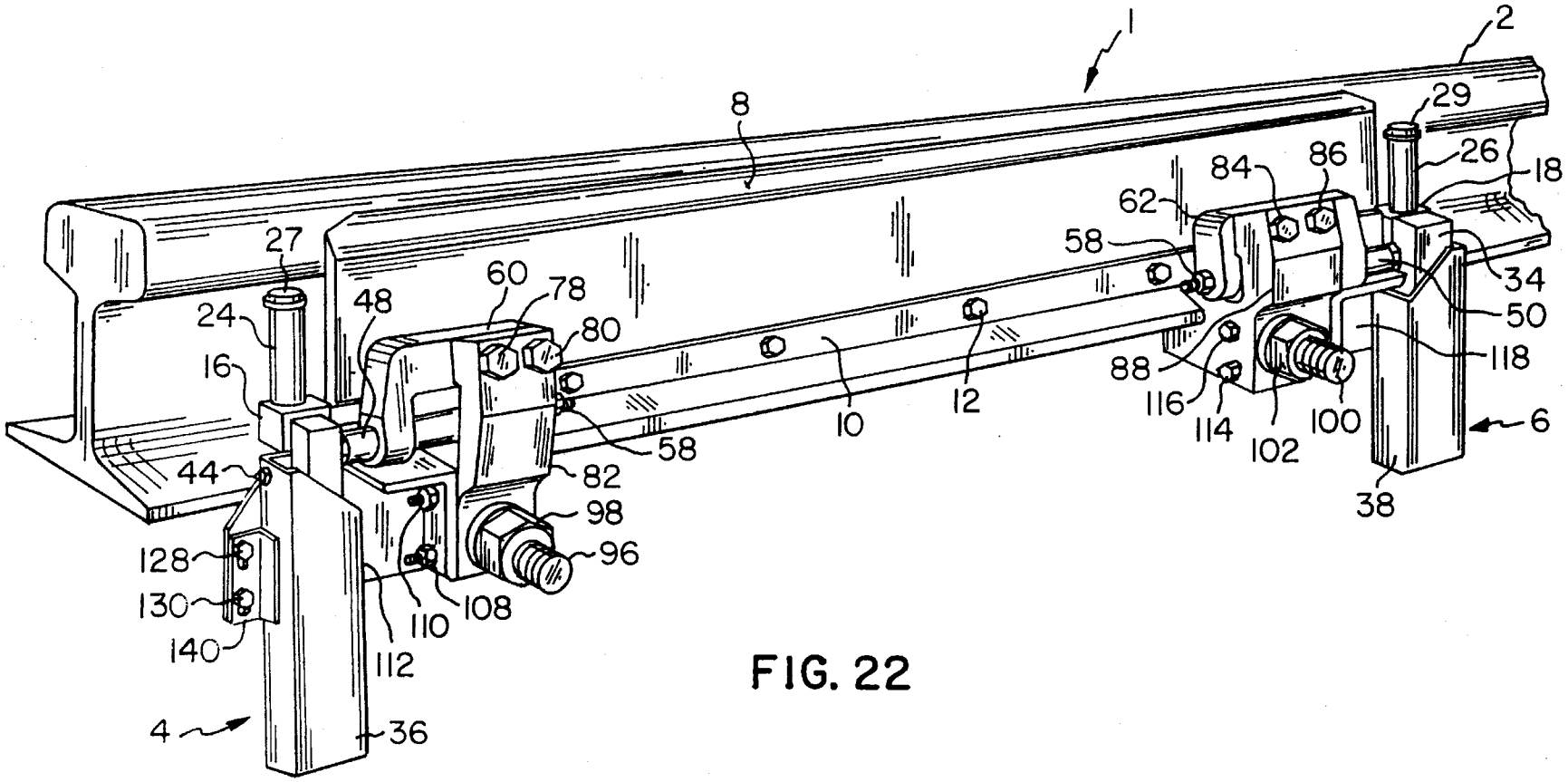
FIG. 22 is a perspective of an alternative embodiment of the present invention.

FIG. 22 shows another embodiment of the invention, wherein all elements are described and shown, with the exception that release rods 70 and 72 and release rod springs 156 and 158 are not present. In this embodiment, solid lubricant element 8 floats in an upwardly direction as the vibration of the wheels passing over solid lubricant element 8 transfers vibrational forces along solid lubricant element 8 and along the rails thereby permitting solid lubricant element 8 to rise. This embodiment is particularly useful where the railed vehicle is traveling at speeds high enough to generate substantial vibrational forces.

FIG. 23 shows another embodiment of the invention with a much shorter lubricating element 8 and holder 10, which permits the use of a single subassembly 4 including a single braking assembly, lifting assembly and releasing assembly attached to rail 2. In this embodiment, it may be desirable to modify guide pin 24 and guide block 16 to prevent guide block 16 from rotating about the axis of guide pin 24. This modification can include any means known in the art, including a keying arrangement.

Advantages of the present invention include that the braking assemblies and release assemblies function together to provide a "floating" system for the solid lubricant element 8 so that when train wheels of differing diameters pass over the solid lubricant element 8, instead of shearing off the top of solid lubricant element 8, the release assemblies permit the solid lubricant element 8 to float downwardly against the force of springs 40 and 42 to allow lubrication without shearing. The floating aspect of the present invention is important because train wheels, in fact, do differ substantially in diameter due to manufacture, wear, repair and replacement. For example, wheels are often trued on a lathe up to 3 or 4 times during the wheel's useful life which can result in as much as a two inch change in the wheel's diameter. A train pulling rolling stock will, therefore, necessarily have wheels with very different profiles including new wheels, wheels needing truing, wheels trued a first time and wheels trued a plurality of times.

Other advantages of the present invention include those generally obtained when a solid lubricant is utilized, such as reduced environmental hazard, formation of a constant small lubricant layer on the rail no more than one-half mil thick, and fewer elements required for the system, such as pumping and distribution means. Advantages unique to the present invention include its wayside attachment, self-leveling capability and the prevention of shearing of the solid lubricant element as disclosed above.

Another advantage is that a wayside lubrication system is easier to maintain than rolling stock equipment due to the fact that rolling stock equipment is scattered throughout the country. Additionally, it is easier to lubricate the rails as opposed to refitting all rolling stock with solid lubricant systems. A further advantage of the present invention is that it permits placement of the lubricant where it is needed the most, at, for example, the beginning of sharp turns and does not result in the application of lubricant where none is needed as is commonly the case with on-board lubrication systems. Another advantage of the present invention is that it can be used in conjunction with on-board lubrication elements for a given application, if needed.

While the present invention has been described with respect to applying a solid lubricant to railed vehicles, it is to be noted that it is within the scope of the invention to replace solid lubricant element 8 with any material that can be fashioned into a solid or semi-solid plate. For example, where friction, as opposed to lubrication, is desired, solid lubricant element 8 can be substituted with an anti-slip element.

While different embodiments of the invention are shown and described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

We claim:

1. An apparatus for applying material to wheels of a wheeled vehicle as said wheels pass along a rail over said apparatus, comprising:

a) a base;

b) means for attaching said base to said rail;

c) a material holder attached to said base, said material holder being parallel to said rail and biased in a first upward direction toward said wheels of said wheeled vehicle passing over said material holder;

d) at least one brake attached to said base biased against said material holder; and e) at least one brake release, wherein said brake is released when said brake release is activated and said material holder is urged upwardly toward the wheels.

2. The apparatus of claim 1, wherein said brake release is actuated by said wheels of said wheeled vehicle passing over said brake release.

3. The apparatus of claim 1 further comprising a material element retained by said material holder, wherein said material element is selected from the group consisting of a lubricating element and an anti-slip element.

4. The apparatus of claim 3, wherein said material element is in the form of a plate approximately two feet in length, 5 inches in height and one-half inch in thickness.

5. The apparatus of claim 1, wherein said material holder comprises:

a) a U-shaped channel having a first end and a second end;

b) at least one guide block attached to said U-shaped channel, said guide block having a hole therethrough in a plane perpendicular to the length of said U-shaped channel; and c) a lift bar connected to said guide block via a connecting member, said lift bar located in a plane parallel to the axis of said hole within said guide block but extending below said guide block with respect to the top of said rail.

6. The apparatus of claim 5, further comprising a subassembly, wherein said base is a rail clamp attached to said rail with a J-bolt, and wherein said subassembly includes:

a) a guide pin bracket attached to said base and including an upwardly extending guide pin along which said guide pin block travels as said material holder is urged upwardly toward the wheels by said bias and downwardly away from the wheels by the weight of the wheels;

b) a lift bar guard attached to said guide pin bracket in which said lift bar travels as said material holder moves relative to the wheels;

c) a spring within said lift bar guard operating on said lift bar between said lift bar guard and said lift bar to urge said lift bar upwardly toward the wheels;

d) a brake and release rod guide attached to said base for guiding said brake and guiding said release rod, wherein said brake is a rod having a head at a first end and threads at a second end and a tapered groove therethrough, said tapered groove located between said first end and said second end of said rod and wherein said rod travels within said brake and release rod guide essentially parallel to said rail and, wherein said head of said rod is biased against said lift bar and, wherein said tapered groove is essentially perpendicular to the plane of said travel of said rod;

e) a spring operating on said brake between said brake and said brake and release rod guide to urge said brake against said lift bar;

f) a release rod having a first upper end and a tapered portion at a second lower end opposite said first end, said release rod traveling essentially vertically perpendicularly to the length to said rail, wherein said release rod is biased upwardly toward said wheels and, wherein said tapered portion intersects said tapered groove in said brake; and g) a spring operating on said release rod between said brake and release rod guide and said release rod to urge said release rod upwardly toward the wheels.

7. The apparatus of claim 6, wherein said release rod further includes a head at said first upper end of said release rod.

8. The apparatus of claim 7, wherein said release rod head is removably fixed to said first upper end of said release rod.

9. The apparatus of claim 7 including a material element fixed within said U-shaped channel.

10. The apparatus of claim 6, wherein said head of said brake rod is removably fixed to said rod.

11. The apparatus of claim 6, wherein said head of said brake rod includes a serrated face including gripping teeth.

12. The apparatus of claim 6, wherein said head of said brake rod includes a smooth face.

13. The apparatus of claim 6, wherein said U-shaped channel includes:

a) a first guide block attached at said first end of said U-shaped channel, said first guide block having a hole therethrough in a plane perpendicular to the length of said U-shaped channel;

b) a first lift bar connected to said first guide block via a first connecting member;

c) a second guide block attached at said second end of said U-shaped channel, said second guide block having a hole therethrough in a plane perpendicular to the length of said U-shaped channel;

d) a second lift bar connected to said second guide block via a second connecting member; and e) a pair of said subassemblies, with a first subassembly associated with said first lift bar and a second said subassembly associated with said second lift bar.

14. The apparatus of claim 13 further comprising a connecting bar interposed between and fixed to said rail clamps.

15. The apparatus of claim 14, wherein said connecting bar is an angle iron.

16. The apparatus of claim 13 further comprising:

a) a connecting bar interposed between and fixed to said release rods; and b) a head fixed to said connecting bar at about the midpoint of said connecting bar, said head oriented in a plane essentially perpendicular to the length of said connecting bar and, whereupon said head and said connecting bar simultaneously activate each of said relase rods associated with said first and said second subassemblies when the wheels of the wheeled vehicle pass over said brake release.

17. The apparatus of claim 13 further comprising a connecting means interposed between and fixed to said guide pin brackets of said first and said second subassemblies, wherein said connecting means functions to ensure that the orientations of said guide pins in a vertical plane through the axis of said guide pins of said first and second subassemblies are substantially parallel.

18. The apparatus of claim 17, wherein said connecting means is a connecting bar.

19. The apparatus of claim 18, wherein said connecting bar is an angle iron.

20. The apparatus of claim 5 further comprising a subassembly, wherein said base is a rail clamp attached to said rail with a J-bolt and, wherein said subassembly includes:

a) a guide pin bracket attached to said base and including an upwardly extending guide pin along which said guide pin block travels as said material holder is urged upwardly toward the wheels by said bias and downwardly away from the wheels by the weight of the wheels;

b) a lift bar guard attached to said guide pin bracket in which said lift bar travels as said material holder moves relative to the wheels;

c) a spring within said lift bar guard operating on said lift bar between said lift bar guard and said lift bar to urge said lift bar upwardly toward the wheels;

d) a brake guide attached to said base for guiding said brake, wherein said brake is a rod having a head at a first end and threads at a second end and a tapered groove therethrough, said tapered groove located between said first end and said second end of said rod and, wherein said rod travels within said brake guide essentially parallel to said rail and, wherein said head of said rod is biased against said lift bar and, wherein said tapered groove is essentially perpendicular to the plane of travel of said rod; and f) a spring operating on said brake between said brake and said brake guide to urge said brake against said lift bar.

21. The apparatus of claim 20, wherein said head of said brake rod is removably fixed to said rod.

22. The apparatus of claim 20, wherein said head of said brake rod includes a serrated face including gripping teeth.

23. The apparatus of claim 20, wherein said head of said brake rod includes a smooth face.

24. The apparatus of claim 20, wherein said U-shaped channel includes:

a) a first guide block attached at said first end of said U-shaped channel, said first guide block having a hole therethrough in a plane perpendicular to the length of said U-shaped channel;

b) a first lift bar connected to said first guide block via a first connecting member;

c) a second guide block attached at said second end of said U-shaped channel, said second guide block having a hole therethrough in a plane perpendicular to the length of said U-shaped channel;

d) a second lift bar connected to said second guide block via a second connecting member; and e) a pair of said subassemblies, with a first subassembly associated with said first lift bar and a second said subassembly associated with said second lift bar.

25. The apparatus of claim 24 further comprising a connecting bar interposed between and fixed to said rail clamps.

26. The apparatus of claim 25, wherein said connecting bar is an angle iron.

27. The apparatus of claim 24 further comprising a connecting means interposed between and fixed to said guide pin brackets of said first and said second subassemblies, wherein said connecting means functions to ensure that the orientations of said guide pins in a vertical plane through the axis of said guide pins of said first and second subassemblies are substantially parallel.

28. The apparatus of claim 27, wherein said connecting means is a connecting bar.

29. The apparatus of claim 28, wherein said connecting bar is an angle iron.

30. A method of applying material to wheels of wheeled vehicles as said wheels pass along a rail, comprising:

a) affixing a means for applying said material to said rail;

b) associating a material element with said means; and c) causing said wheels to pass along said rail over said means;

wherein said means includes:

i) a base;

ii) means for attaching said base to said rail;

iii) a material holder attached to said base, said material holder being parallel to said rail and biased in a first upward direction toward said wheels of said wheeled vehicle passing over said material holder;

iv) at least one brake attached to said base biased against said material holder; and v) at least one brake release, wherein said brake is released when said brake release is activated and said material holder is urged upwardly toward the wheels.

31. The method of claim 30, wherein said material element is selected from the group consisting of a lubricating element and an anti-slip element.

* * * * *